United States Patent [19]

Marggraff

[11] Patent Number: 4,690,089

[45] Date of Patent: Sep. 1, 1987

[54] BOAT WITH A RAISABLE AND LOWERABLE KEEL

[76] Inventor: Kaupman Marggraff, Schwanenstieg 1, 7750 Konstanz 16, Fed. Rep. of Germany

[21] Appl. No.: 821,077

[22] Filed: Jan. 21, 1986

[30] Foreign Application Priority Data

Jan. 22, 1985 [DE] Fed. Rep. of Germany ..... 3501892
Apr. 26, 1985 [DE] Fed. Rep. of Germany ..... 3515090

[51] Int. Cl.[4] ..... B63B 41/00
[52] U.S. Cl. ..... 114/141; 114/138
[58] Field of Search ..... 114/127–143; 49/445

[56] References Cited

U.S. PATENT DOCUMENTS

| | | | |
|---|---|---|---|
| 1,022,725 | 4/1912 | Delafield | 114/141 |
| 3,371,737 | 3/1968 | Hall | 114/141 |
| 3,547,065 | 12/1970 | Chauveau | 114/138 |
| 3,572,279 | 3/1971 | Smoot | 114/132 |
| 3,902,441 | 9/1975 | Scholle | 114/132 |
| 4,004,536 | 1/1977 | Bernier | 114/142 |
| 4,316,425 | 2/1982 | Guido | 114/141 |

FOREIGN PATENT DOCUMENTS

| | | | |
|---|---|---|---|
| 819916 | 9/1959 | United Kingdom | 114/141 |

*Primary Examiner*—Jeffrey V. Nase
*Assistant Examiner*—C. T. Bartz
*Attorney, Agent, or Firm*—Bachman & LaPointe

[57] ABSTRACT

A boat with a raisable and lowerable keel is proposed, which can be constructed as a swivel, lifting or ballast drop keel. The keels are fixed to tensioning members either directly or via cables. The tensioning members can be spiral springs, which run in the lifting keel box and are guided in the interior of the lifting keel to the lower end thereof. If the lifting keel is lowered, the spiral springs are tensioned, so that only relatively limited forces are required for raising by means of a spindle (FIG 1).

4 Claims, 6 Drawing Figures

BOAT WITH A RAISABLE AND LOWERABLE KEEL

BACKGROUND OF THE INVENTION

The present invention relates to a boat with a raisable and lowerable keel, which is constructed as a lifting or swivel keel or as a ballast drop keel.

Keels with a high weight and a correspondingly large draught are used on sailing yachts to obtain stability to prevent capsizing. As a result of the necessary stability and to reduce drift, the movable keel must at least be largely extended in the case of a fresh wind and under full sail. With a reduced sail area or under motor, it is also possible to travel in shallow water. Only a limited draught is required when berthed in the harbour. Smaller yachts with a raisable keel also require no berth in the water, can be hauled on land by a trailer using a slipway and left there. It is also possible to reach remote locations with a towing vehicle, an ordinary car being sufficient in the case of smaller and medium-sized yachts. There is also no longer any danger when running aground, because the yacht is freed again after raising the keel.

SUMMARY OF THE INVENTION

The problem of the present invention is to provide a boat of the aforementioned type, in which the raisable keel can have a relatively large weight.

Acoording to the invention this problem is solved by the features of the main claim. When lowering the keel, the tensioning members connected to it can be tensioned by the weight thereof, so that the raising is assisted by the tension of the tensioning members. The tensioning members can be constituted by springs, gas pressure-operated means or the like.

According to the preferred embodiment, tubular channels are provided in a lifting keel and spiral springs run along the same up to the lower end of the keel. The other end of the springs are fixed in the lifting keel box outside the keel. The lifting keel box preferably extends up to the top of the cabin, where the springs can be fixed. The springs can be constructed in such a way that their spring tension acting on the keel at least approximately corresponds to the keel weight, less the buoyancy, in the case of a completely lowered keel. Initially only a very limited force is then required for raising the keel. The keel can be raised by means of a fixed spindle on the top of the cabin, which engages in a threaded member or the like fixed to the lifting keel.

The lifting keel suspended on the springs has the advantage that the draught can be reduced with limited force expenditure. The springs can also be pretensioned or biased, so that a spring tension aiding the raising process is also effective when the keel is completely raised. However, the biasing of the springs is frequently unnecessary, because the complete raising of the keel is only rarely necessary. The pitch of the spindle can be chosen in such a way that the complete raising of the lifting keel is possible manually without any assisting spring tension.

The upper region of the lifting keel guided in the keel box has a different profiling from the part lowerable into the water. The passage opening provided in the bottom of the boat and through which the keel is passed also forms a guide for the keel, which as a metal part can be very accurately adapted to the profile of the part passed through.

In the same way as the lifting keel, it is also possible to collect a swivel keel or a ballast drop keel to a tensioning member outside its pivot axis. Thus, e.g. a tension spring can be connected via a hauling rope with the drop keel part projecting into the keel box. The tension spring can also have a vertical position, the hauling rope being guided over guide pulleys. This construction leads to the advantage that the swivel keel can have a higher weight, because the raising of said keel can e.g. be aided by spring tension. Here again a spindle can be used for lowering and hauling up the swivel keel. A runner can be provided on the spindle and is connected with the swivel or drop keel via cables, which can also be guided over one or more guide pulleys. The two cables are symmetrically fitted to the runner, so that the latter does not tilt.

The lifting keel on the one hand and the swivel and drop keel on the other can be provided with means permitting an arresting or locking in any random position thus, in both cases screws can e.g. be provided at the upper end permitting a rigid connection between keel and keel box. The keel can be secured by means of a synthetic fibre line. The line can be constructed in such a way that it acts as a desired breaking point on contact with the ground and allows a falling back or giving way of the keel.

The tensioning members can also be constituted by compression springs, which run in tubular spring channels formed on the lifting keel. The lower end of the compression springs engages on a stop member rigidly connected to the boat, whilst the upper end of said springs engages on a stop member connected to the lifting keel. The connection of compression springs has the important advantage compared with the use of tension springs that the risk of a spring break is virtually non-existent in the case of compression springs. With the lifting keel completely lowered, the compression springs used can be completely compressed, said springs being loadable with compressive forces which are much higher than the maximum spring tension.

Further advantageous developments of the invention are characterized in the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
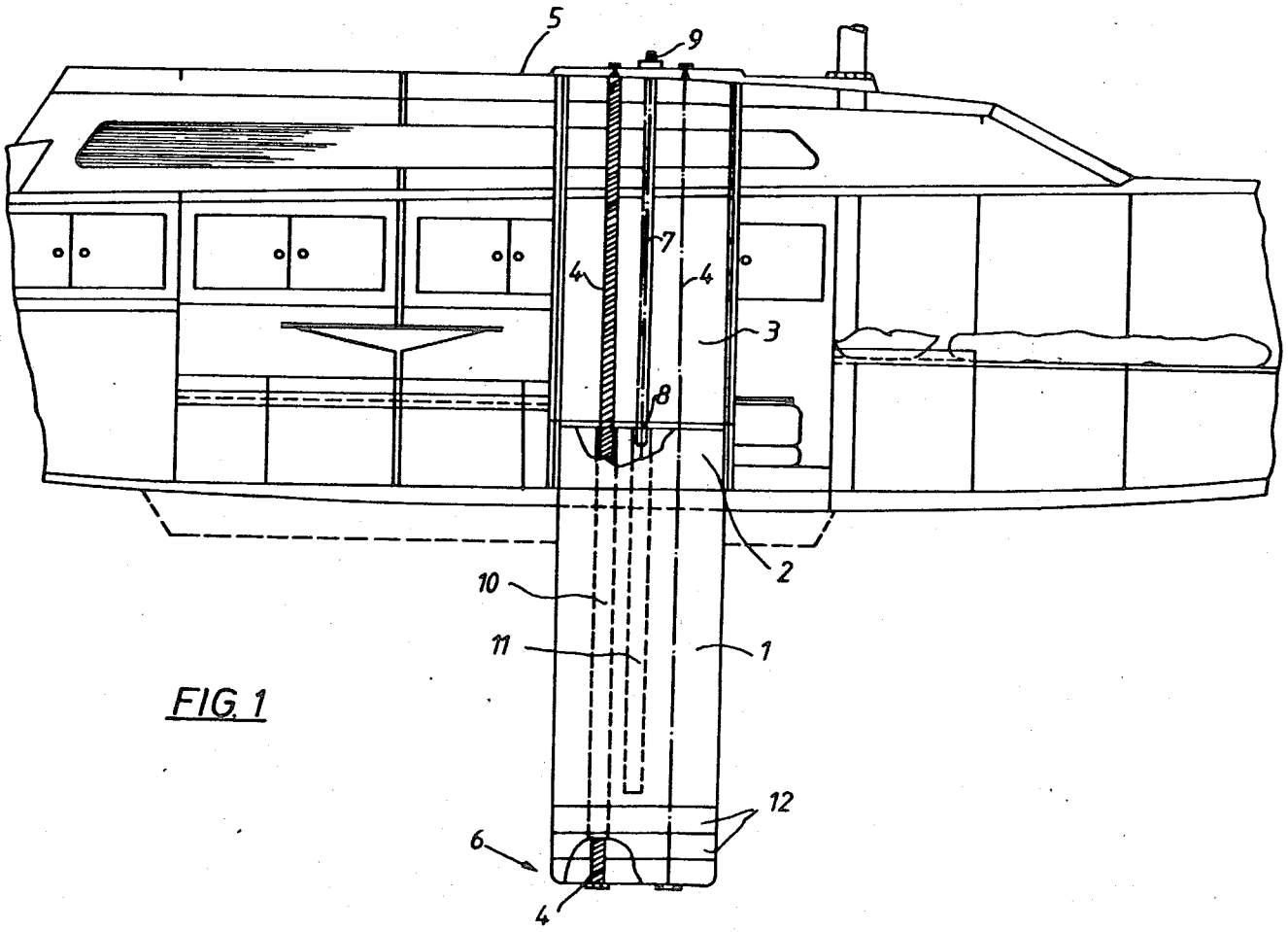
FIG. 1 A detail of a side view of a yacht with a lifting keel, partly in section.

The yacht shown in FIG. 1 has a lifting keel 1, whose upper area 2 is guided in a lifting keel box 3. In the represented embodiment, there are two spiral springs 4 acting as tensioning elements in the lifting keel box 3, but only the right-hand spring is visible. The spiral springs 4 run from the top of the cabin 5, where the lifting keel box 3 ends to the lower end 6 of the lifting keel 1. At the centre of gravity of lifting keel 1 there is a spindle 7, which is fixed in rotary manner in the vicinity of the cabin top or roof 5. At its lower end 8, it engages on the lifting keel 1 in a corresponding thread or the like. On turning spindle 7, it is possible to raise the lifting keel 1 or lower it into the position shown here.

FIG. 1 shows the lifting keel 1 completely lowered, the spiral springs 4 being under maximum tension. The total force acting on lifting keel 1 as a result of the two spiral springs 4 can correspond to the weight of said keel, less the buoyancy caused by the water. Spindle 7 can easily be operated by hand, e.g. by means of a crank mounted at its upper end. For this purpose, the upper end of spindle 7 is constructed as a square end 9. The mounting of spindle 7 in the vicinity of the cabin top or roof 5 or in the vicinity of the upper end of the lifting keel box 3 takes place by means of thrust ball bearings.

The spiral springs 4 are guided in spring channels 10 in the lifting keel 1. A corresponding spindle channel 11 is provided for spindle 7. Channels 10 and 11 are preferably constructed in tubular manner and adapted to the diameter of either spiral springs 4 or spindle 7.

The spiral springs 4 can be biased when the lifting keel 1 is completely raised. It is also possible to construct the spiral springs 4 in such a way that with the keel 1 completely lowered they exert a larger force than would be necessary for raising said keel. In the final zone, the lifting keel 1 must in this case be forced downwards by means of spindle 7.

Figure 2:
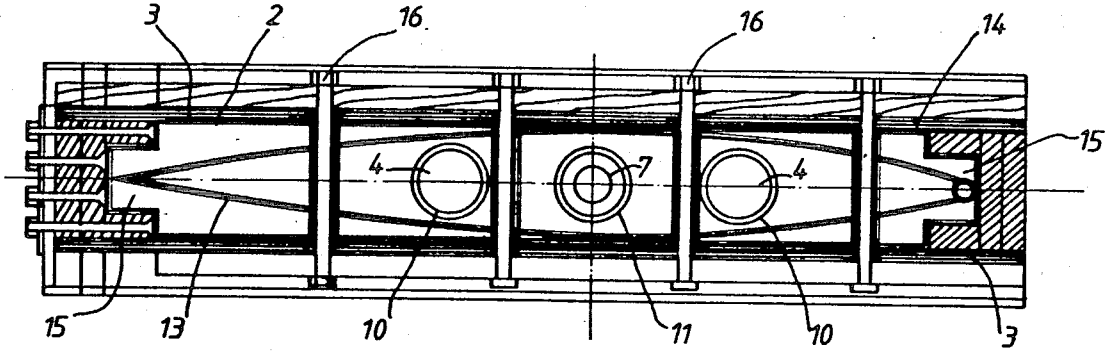
FIG. 2 The lifting keel of FIG. 1 in section.

In the section AB shown in FIG. 2, it is in particular possible to see the profile of the upper area 2 of the lifting keel 1 and its remaining profile 13. The lifting keel box 3 essentially has a rectangular profile 14 with two rectangular bulges 15. In FIG. 2 there are also tubular channels 10,11 for receiving the spiral springs 4 and spindle 7. Several laterally arranged screws 16 are provided on the lifting keel box 3 so that the keel can be locked in the completely lowered or any other random position.

Figure 3:
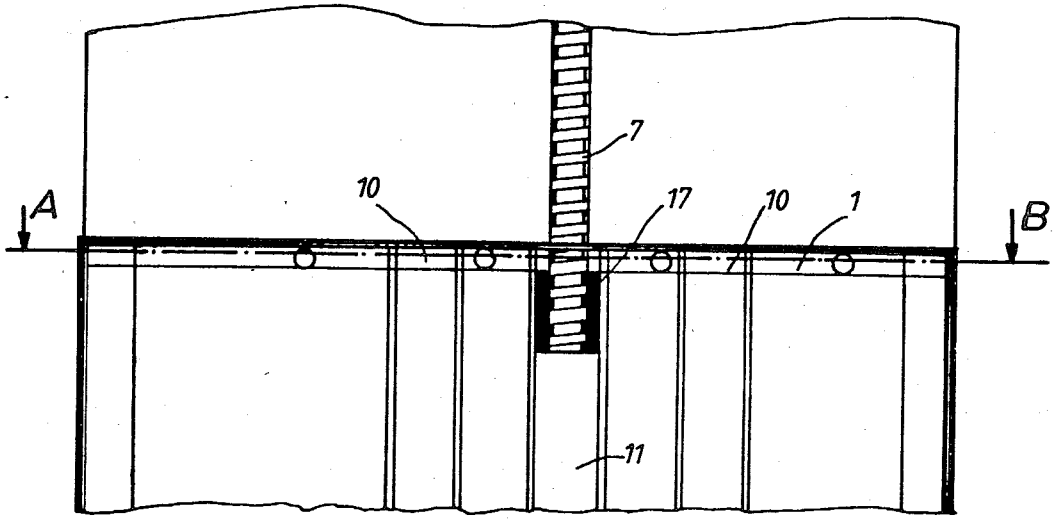
FIG. 3 A detail of the lifting keel in the vicinity of the spindle.

FIG. 3 is a detail showing on a larger scale than in FIG. 1 spindle 7 and the upper end of lifting keel 1. Thus, at its upper end, the spindle channel 11 has a threaded portion 17 in which engages the spindle 7.

Figure 4:
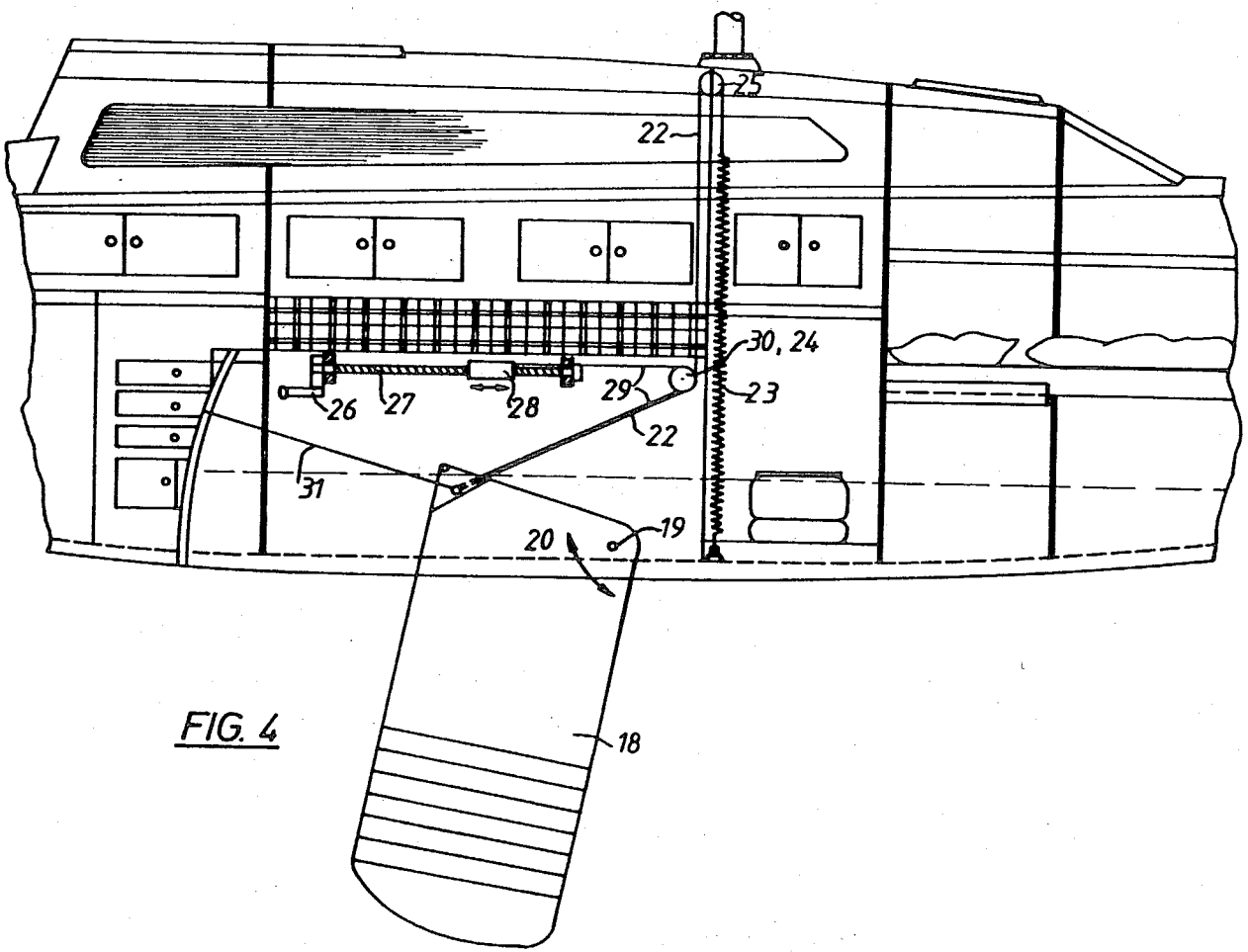
FIG. 4 An arrangement with a swivel keel.

FIG. 4 shows an arrangement with a swivel keel 18, which is pivotably mounted about a pivot pin 19 corresponding to the arrow direction 20.

At a distance from pivot pin 19, swivel keel 18 is connected via a hauling rope 22 with a tensioning member constructed as a tension spring 23. The hauling rope 22 is guided over two guide pulleys 24,25, so that the tension spring 23 can be arranged in positionally independent manner of the swivel keel 18.

A spindle 27 operable by a hand crank 26 carries a runner 28, which is connected via a cable 29 to the swivel keel 18. Cable 29 is guided over a guide pulley 30. The arrangement of spindle 27 is shown in principle. The spacial arrangement of the spindle is obviously chosen in such a way that hand crank 26 is readily accessible.

As a result of the rotation of spindle 27, as a function of the rotation direction, runner 28 moves to the left or right, so that the swivel keel 18 can be raised or lowered. On lowering, hauling cable 22 tensions tension spring 23, so that in the same way as for the lifting keel raising can take place with a reduced force.

As required, swivel keel 18 can be locked in any random position by a screw or by means of an at least slightly elastic line 31. Line 31 can e.g. be a synthetic fibre cable, which can represent a desired breaking point. In the case of correspondingly strong ground contact, the swivel keel 18 can be forced so strongly upwards that the line 31 tears and keel 18 can swing upwards in an unimpeded manner.

It is pointed out that the raising and lowering of the keel can also take place by a hydraulic drive or a motor, e.g. a battery-operated electric motor.

The drop keel used is in all cases a ballast drop keel, but the latter can also be replaced by a swivel keel. To operate the swivel keel, it is also possible to use means other than the spindle 7 employed in the embodiment. Thus, e.g. a winch with cables or belts can be used.

Figure 5:
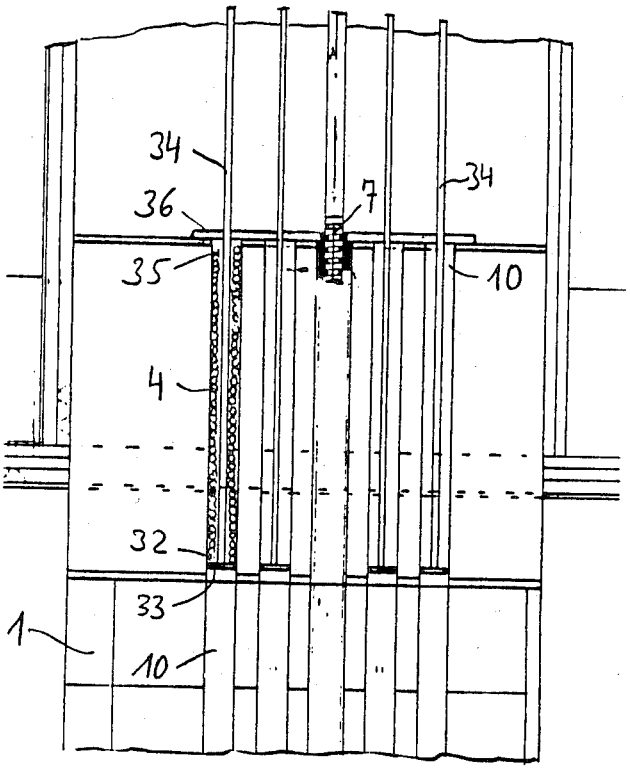
FIG. 5 An arrangement with compression springs.
Figure 6:
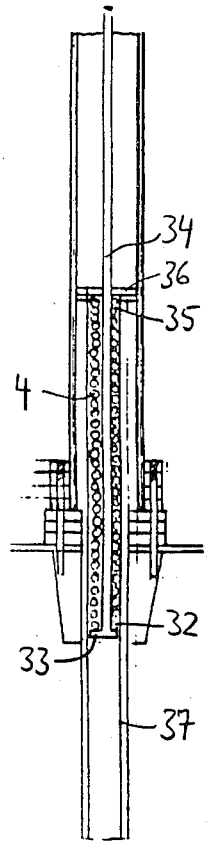
FIG. 6 Another embodiment with compression springs.

FIGS. 5 and 6 show two constructions with spiral springs 4 used as compression springs. The lower end 32 thereof presses against a plate-like stop 33, which is rigidly connected via a vertically upwardly directed rod 34 to the upper end of the lifting keel box or to the cabin roof. The upper end 35 of spiral springs 4 presses against a stop member 36, which is rigidly connected with the lifting keel 1. In the case of the construction shown in FIG. 5, stop member 36 forms an upper cover for the tubular channels 10, whilst in the embodiment shown in FIG. 6 stop member 36 defines a pipe 37 at the top, which is connected to lifting keel 1 in a manner not shown here. For reasons of simplicity, FIG. 6 only shows one of several spiral springs 4.

What is claimed is:

1. A boat having a movable lifting keel guided in a lifting keel box, said lifting keel having a top and a bottom and being provided with a plurality of channels extending from said top toward said bottom, compression springs positioned in said plurality of channels such that one end of said compression springs presses against a lower stop connected to said boat and the other end presses against an upper stop connected to said lifting keel, and a plurality of rods connected to said boat and passing through said compressing springs, said rods having on their lower ends a plate forming said lower stop.

2. A boat according to claim 1 wherein a spindle is mounted in rotary manner and is fixed to the upper end of the lifting keel box and is directed downwards and engages the lifting keel for raising and lowering same.

3. A boat according to claim 2 wherein the lifting keel is provided with a spindle channel and the spindle projects into said spindle channel.

4. A boat according to claim 1 wherein the lifting keel is provided with means for locking same in random position with respect to the lifting keel box.

* * * * *

UNITED STATES PATENT AND TRADEMARK OFFICE

CERTIFICATE OF CORRECTION

PATENT NO. : 4,690,089

DATED : September 1, 1987

INVENTOR(S) : FRITZ MARGGRAFF

It is certified that error appears in the above-identified patent and that said Letters Patent is hereby corrected as shown below:

On the Cover Page, the inventor's name should be changed from "Kaupman Marggraff" to --Fritz Marggraff--.

Signed and Sealed this

Eighth Day of August, 1989

*Attest:*

*Attesting Officer*

DONALD J. QUIGG

*Commissioner of Patents and Trademarks*